US007051443B2

(12) United States Patent
Mueller

(10) Patent No.: US 7,051,443 B2
(45) Date of Patent: May 30, 2006

(54) MULTI-FUNCTION HEAVY DUTY UTILITY KNIFE WITH STABILIZER PIVOT STRUCTURE

(76) Inventor: Kristopher Joseph Mueller, 7 Pine Ridge Rd., Asheville, NC (US) 28804

( * ) Notice: Subject to any disclaimer, the term of this patent is extended or adjusted under 35 U.S.C. 154(b) by 0 days.

(21) Appl. No.: 10/700,912

(22) Filed: Nov. 1, 2003

(65) Prior Publication Data

US 2004/0216309 A1 Nov. 4, 2004

Related U.S. Application Data

(60) Provisional application No. 60/466,303, filed on Apr. 29, 2003.

(51) Int. Cl.
*B26B 29/06* (2006.01)

(52) U.S. Cl. ..... 30/286; 30/125

(58) Field of Classification Search ..... 30/153, 30/155, 158, 159, 151, 125, 329, 330, 286, 30/289, 291, 295, 2, 142
See application file for complete search history.

(56) References Cited

U.S. PATENT DOCUMENTS 449,031 A * 3/1891 Bernard ..... 30/295
4,062,116 A 12/1977 Arnott
4,087,911 A * 5/1978 Schrock et al. ..... 30/286
4,531,286 A * 7/1985 Vito et al. ..... 30/2
4,546,510 A * 10/1985 Harrison ..... 7/145
4,672,745 A * 6/1987 Wilkens ..... 30/340
4,817,221 A * 4/1989 Ryan ..... 7/148
4,910,821 A 3/1990 Kieferle
5,031,322 A * 7/1991 Jacoff ..... 30/162
5,072,471 A 12/1991 Isler
5,241,750 A * 9/1993 Chomiak ..... 30/2
5,299,355 A 4/1994 Boda et al.
5,386,632 A * 2/1995 Schmidt ..... 30/125
5,404,645 A * 4/1995 Janser ..... 30/125
5,711,077 A 1/1998 Schulz et al.
6,226,824 B1 5/2001 Hopson et al.
6,324,763 B1 * 12/2001 Lee ..... 30/162
6,427,569 B1 * 8/2002 MacDonald ..... 83/13
6,484,404 B1 11/2002 Kao
6,748,659 B1 * 6/2004 Street ..... 30/2
2004/0250425 A1 * 12/2004 Arent et al. ..... 30/142

* cited by examiner

*Primary Examiner*—Hwei-Siu Payer
(74) *Attorney, Agent, or Firm*—Jacobson Holman PLLC

(57) ABSTRACT

A heavy duty utility knife with ergonomic finger and thumb positions in relation to an internal stabilizer pivot structure which includes a wheel for safer, stronger, smoother and more efficient cutting. The knife also provides the user with an easy access, blade change and storage feature. This feature allows for proficiency of task, as well as, creating a safe knife with a skid plate to prevent injury.

12 Claims, 4 Drawing Sheets

MULTI-FUNCTION HEAVY DUTY UTILITY KNIFE WITH STABILIZER PIVOT STRUCTURE

RELATION TO PRIOR APPLICATION

This is a U.S. non-provisional application relating to and claiming the benefit of U.S. Provisional Application Ser. No. 60/466,303 filed Apr. 29, 2003.

BACKGROUND OF INVENTION

1. Field of Invention

This Invention relates to a hand held multiple use utility knife structure with specific ergonomic features for your fingers and thumb, in relation to the stabilize pivot structure. The knife contains a blade storage area and facilitates a quick open blade exchange, creating a unique tool for almost every field of construction, trades and home use. The design of the said structure provides the user with multiple ways to grip the tool, apply different amounts of pressure, and create leverage. The primary objective of the present invention is to provide leverage thus creating a safer working tool to minimize potentially harmful situations in dangerous heavy and light duty tasks.

2. Description of Prior Art

Prior inventions do have rollers or multiple wheels attached to utility knives. Almost all Construction Trades use utility knives depending on the scope of different applications in different industries. An example of Heavy Duty use is the roofing trade in which knives are the base tool for cutting and scoring shingles. Due to the heavyweight material used considerable pressure is exerted in order to cut the material. Thus, the Utility Knife plays an important role in the construction industry.

Innovation with design is needed to maintain safety and proficiency. The ineffective structure of traditional utility knives provides no support or stabilized pivot points with no way to create leverage thus creating a lack of precision cutting. In order to make a simple cut or score in a straight line traditional knives force the user to create leverage by straining the wrist or insure stability by straining the entire arm allowing for harmful situations.

Beyond the traditional utility knives there are several types of trade specific cutting tools. For example: fabric, sewing fabrics, screen splining, and even exacting knives with no heavy duty or multi-use design. Generally these are useful tools when applied to their specific industry or duty application but may be harmful when applied to other industries where proper cutting tools may be necessary.

In conclusion, I have found the need to create a knife with heavy duty, multi-use functions and design to assist in maintaining safety. The main goal asserted is in providing the roofing, sewing, flooring and any other construction industry (but not limited to these specifically) with a utility knife that maintains precision cutting in all heavy and light duty tasks.

SUMMARY OF INVENTION

The primary objective of the present invention is to provide a stabilizer pivot structure, consisting of an internally mounted stabilizer pivot roller wheel with a rear skid plate to create a safer, more efficient utility knife to grip and handle in completing all construction tasks.

An additional objective of the present invention is to provide a Heavy Duty Multi use utility knife with ergonomic finger and thumb rests, pointer finger hub hole, stabilizer pivot structure with a spin opening, easy change blade and blade storage to create a safer, more efficient utility knife. By achieving these objectives a multi use tool of this kind will replace tools of inferior design.

This efficient, effective tool with multiple features maximizes safety, precision and versatility, concluding that this tool is unique and superior in its design. Other prior art displays that inferior design tools do not have heavy duty construction with precision elements needed in the prior art embodiment to complete necessary tasks.

In accordance with one form of this invention, there is provided a utility knife, including a housing, having a forward portion, a rear portion, and a middle portion. A cutting member is attached to the forward portion. The rear portion includes a grip for enabling a user to grasp the knife with a hand. A pivot wheel is attached to the middle portion. At least a part of the pivot wheel is received inside the housing so that the knife is stabilized during use. Preferably, the rear portion also includes a skid plate for protecting the user's hand.

BRIEF DESCRIPTION OF THE DRAWINGS

FIG. 4-1 is a bottom view of present invention.

FIG. 4-2 is a side view of present invention.

FIG. 4-3 is an explode view of the opening mechanism.

DETAILED DESCRIPTION

Figure 1:
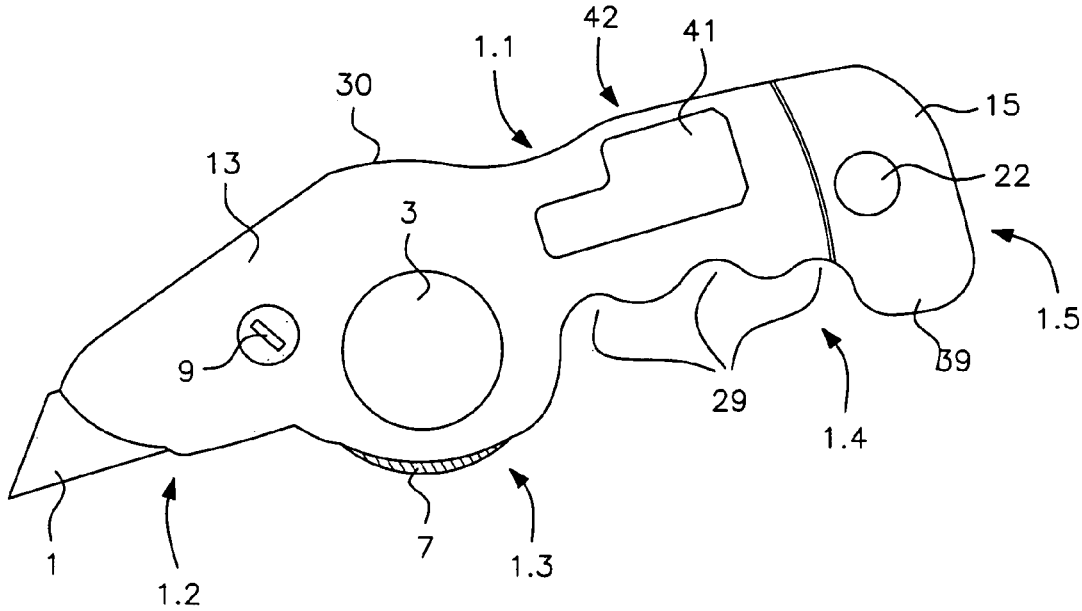
FIG. 1 is a side view of present invention.

FIG. 1 shows one preferred embodiment of the present invention. A utility knife, in the form of housing 1.1, with blade 1 at forward portion 1.2, a stabilizer pivot wheel at middle portion 1.3 and on the bottom and a pointer finger hub hole 3 which you put your index finger through. Ergonomic finger rests or grip 29 at rear portion 1.4 and ergonomic finger rest 30 all create solid grip options for gripping. Knife housing first side 13 with female fastening nut for spin opener 9 along with knife housing second side 15 and spin opener engager for notch 22 creating a feature for quick blade change and storage called the spin opener. Protruding section 1.5 including skid plate 39 at rear of knife added with stabilizer pivot wheel 7 creating a safe way to keep your hand and knuckles from scraping the surface you're cutting. Including ergonomic side indentation 41 can help in additional multitask handling by putting thumb on one side and fingers on the other with ergonomic side indentation 42 to further make a complete knife.

Figure 3:
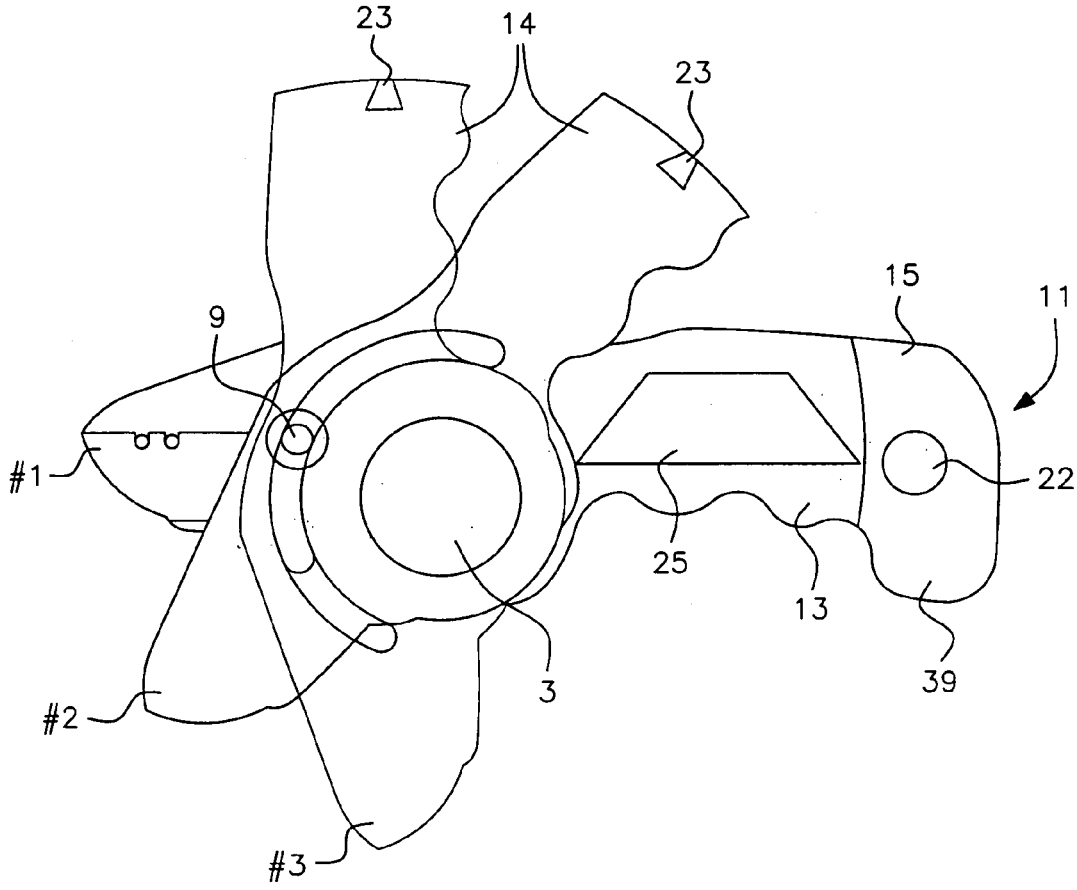
FIG. 3 is a side movement view illustrating opening feature of present invention.
Figure 2:
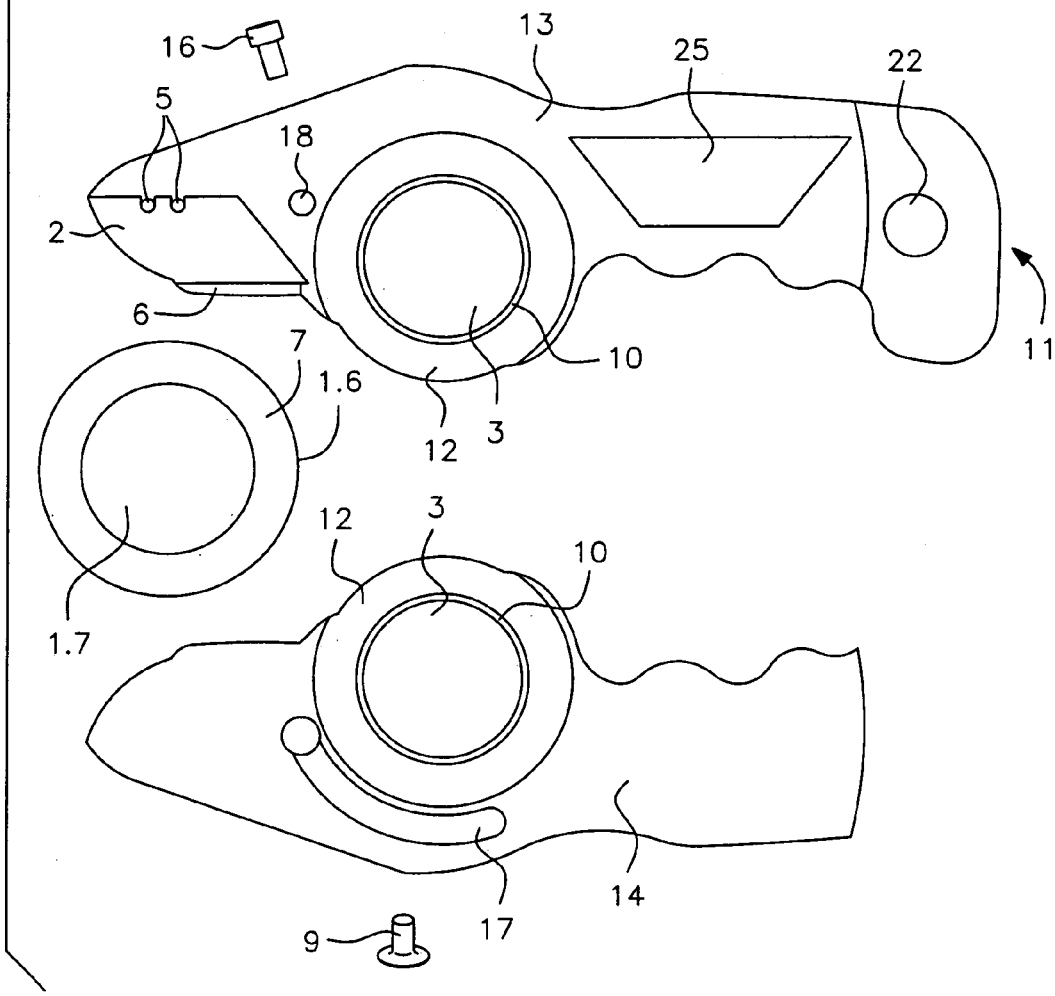
FIG. 2 is an exploded split internal view of present invention.

FIG. 2 shows further features of the present invention. Blade holder 2 and steel plate for blade holder 6 with steel pins for blade holder 5 create a solid and secure area for holding a blade. Knife Housing 13, Knife Housing 14 both sides have a pointer finger roller track 12 which the stabilizer pivot roller wheel 7, in the shape of a ring having rim 1.6 and hub hole 1.7 for receipt of a finger, fits inside and the pointer finger hub wall 10 all create a stabilizer pivot structure. The ring or roller wheel 7 surrounds the opening or hub hole 3 as shown in FIGS. 1–3. To open knife, engage spin opener button 11 opposite the side of the spin opener engager for notch 22 is located. Push knife housing 14 which slides along internal spin opener track 17 held together by female fastening nut or stud for spin opener 9 and male fastening screw for spin opener 16 through hole for nut and screw for spin opener track 18 which opens and exposes blade holder 2 creating an easy blade change and storage.

FIG. 3 to complete the explanation of FIG. 2 and FIG. 3 shows the slide movement in 3 parts. The pointer finger hub hole 3 stays in its original position when knife housing 14 spins along internal curved spin opener track 17 held together with both parts of the female fastening nut for spin opener 9 when the spin opener button 11 is pushed to release the spin opener engager for notch 22 is raised out of locking notch for spin opener catch 23 the knife can be opened to create an easy blade exchange and blade storage 25. This process leaves rear skid plate 39 attached to knife housing 13 comprising spin opener push button 11 which is found within knife housing 15 which is half of the rear skid plate 39. To close knife simply close knife housing 14 together with knife housing 13 back to position 1 and push spin opener button 11 to reset spin opener engaging for notch 22 in locking notch for spin opener catch 23.

Figures 1, 4:
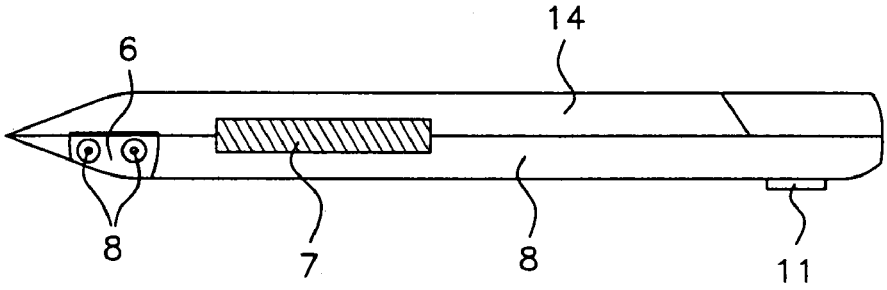
Figures 2, 4:
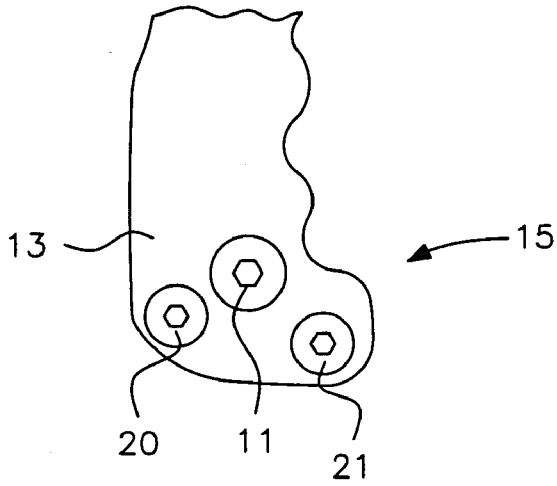
Figures 3, 4:
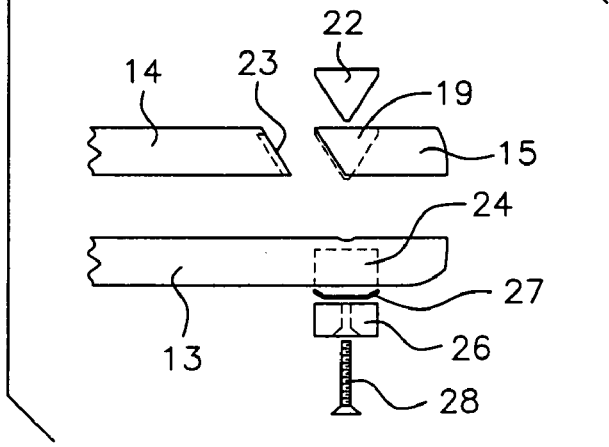

FIG. 4-1 shows the bottom of knife with stabilize pivot wheel inside knife housing 13 and knife housing 14 to create the stabilize pivot structure. Screws for steel plate for blade holder 8 attach steel plate for blade holder 6 to the underneath of knife housing 13 to create a solid area for blade. Spin opener button 11 opposite knife housing protrudes knife housing 13 to engage spin opening.

FIG. 4-2 shows how knife housing 15 is attached with upper fastening screw 20 and lower fastening screw 21 to knife housing 13 with spin opener button 11 shown.

FIG. 4-3 shows the entire spin opener button 11 shown in FIG. 4-2 and FIG. 4-1 is exploded to show how spin opener button 11 mechanism is held together and what it's composed of. Spin opener screw 28 slides into spin opener push button block 26 through round leaf spring 27 all slide into spin opener push button block depression 24 inside knife housing 13 connecting through to spin opener engager for notch depression 19 with spin opener engager for notch 22 to slide into knife housing 15 to create spin opener button 11. When spin opener screw 28 fastens to spin opener engager for notch 22 through all components and are combined, then spin opener button 11 comprising all components is pushed, round leaf spring 27 depresses, spin opener engager for notch 22 releases from locking notch for spin opener catch 23 on knife housing 14 to create easy opening, access to blade storage and easy blade exchange.

Figure 5:
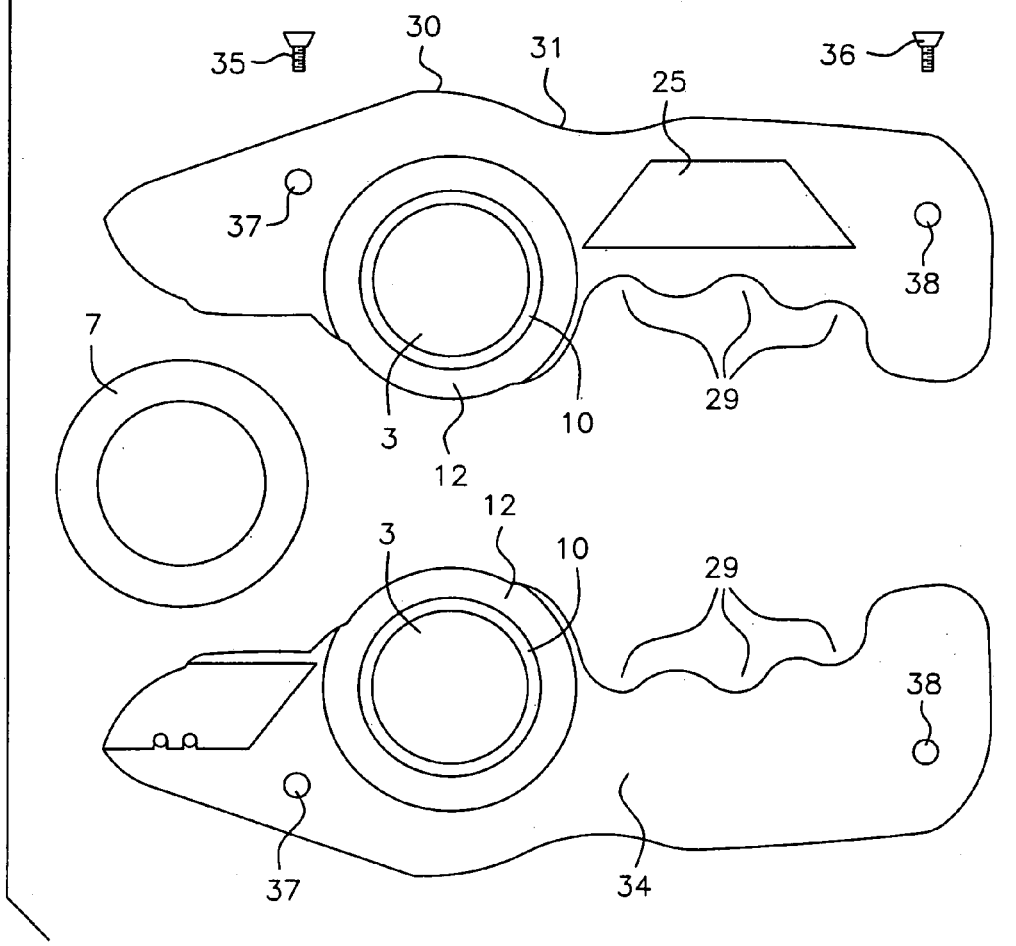
FIG. 5 is a split internal view of specific features of present invention.

FIG. 5 shows an alternative embodiment of the present invention with simple two screw feature fastening with front fastening screw 35 rear fastening screw 36 through front fastening hole 37 and rear fastening hole 38 fastening to knife housing 34 encasing stabilizer pivot roller wheel 7 in pointer finger roller truck 12 with pointer finger hub wall 10 with knife housing 13 creating a utility knife with stabilizer pivot structure and pointer finger hub hole 3 which index finger goes through. Along with ergonomic finger rests 29 ergonomic thumb rest 30 ergonomic thumb position 31 creating a simple fastening heavy duty multi-use utility knife with stabilizer pivot structure.

The complete function of the present utility knife invention prevents strain while heavy cutting and scoring with multiple ergonomic features and unique point finger hub hole. Along with stabilizer pivot structure and rear skid plate create an incredibly safe design when cutting rough material. Unique spin opener, quick blade change and storage is a solid design for proficiency of task.

While this form of apparatus herein explained constitutes preferred embodiment of this invention it is to be understood that the present invention is not limited to this precise form of apparatus and that changes may be made other without departing from the scope of the invention which is defined in the apparatus claims.

The invention claimed is:

1. A utility knife comprising:

a housing;

said housing having a forward portion, a rear portion, and a middle portion;

a cutting member;

said cutting member being attached to said forward portion;

said rear portion, including a grip for enabling a user to grasp the knife with a hand;

a pivot wheel;

said pivot wheel being attached to said middle portion;

at least a part of said pivot wheel being received inside said housing whereby the knife is stabilized during use;

said housing having first and second sides and a mechanism for securing said first side to said second side;

a storage compartment in said housing;

said storage compartment being adapted to receive spare cutting members;

a rotation mechanism for enabling said first and second sides to rotate relative to one another to a second position so that said storage compartment is accessible to the user;

said storage compartment being covered by said first and second sides when said first and second sides are in a first position relative to one another;

said rotation mechanism including a stud attached to and projecting from said first side and a curved track in said second side, said stub being received in said curved tracks, said stud being able to move along said curved track.

2. The utility knife as set forth in claim 1, further including a lock/release mechanism; said lock/release mechanism enabling said first and second sides to be locked into said first position and released to be placed in said second position.

3. The utility knife as set forth in claim 2, wherein said lock/release mechanism includes a push button release mechanism and a locking notch.

4. A utility knife comprising:

a housing;

said housing having a forward portion, a rear portion and a middle portion;

a cutting member;

said cutting member being attached to said forward portion;

said rear portion, including a grip for enabling a user to grasp the knife with a hand;

said middle portion, further including an opening extending through said middle portion;

said opening being adapted to receive an index finger of user;

said middle portion including a stabilizer pivot ring structure, said pivot ring structure surrounding said opening.

5. The utility knife as set forth in claim 4, wherein said rear portion with a protruding section includes a skid plate.

6. A utility knife comprising:

a housing;

said housing having a forward portion, a rear portion, and a middle portion;

a cutting member;

said cutting member being attached to said forward portion;

said rear portion, including a grip for enabling a user to grasp the knife with a hand;

a pivot ring having a hub hole for receipt of a finger;

said pivot ring being attached to said middle portion;

at least a part of said pivot ring being received inside said housing with only a portion of said pivot ring extending from said housing for balanced engagement between said cutting member at said forward portion and said pivot ring at said middle portion by application of force on said forward portion and said middle portion whereby the knife is stabilized during use about said pivot ring.

7. The utility knife as set forth in claim 1, further including a storage compartment in said housing; said storage compartment is adapted to receive spare cutting members.

8. A utility knife comprising:

a housing;

said housing having a forward portion, a rear portion, and a middle portion;

a cutting member;

said cutting member being attached to said forward portion;

said rear portion, including a grip for enabling a user to grasp the knife with a hand;

a pivot ring having a hub hole for receipt of a finger;

said pivot ring being attached to said middle portion;

at least a part of said pivot ring being received inside said housing whereby the knife is stabilized during use;

said housing including first and second sides;

each of said first and second sides including a ring track for receiving said pivot ring.

9. A utility knife comprising:

a housing;

said housing having a forward portion, a rear portion, and a middle portion;

a cutting member;

said cutting member being attached to said forward portion;

said rear portion, including a grip for enabling a user to grasp the knife with a hand;

a pivot ring;

said pivot ring being attached to said middle portion;

at least a part of said pivot ring being received inside said housing whereby the knife is stabilized during use;

an opening extending through said middle portion, said pivot ring surrounding said opening;

said opening being adapted to receive an index finger of the user.

10. The utility knife as set forth in claim 9, wherein said pivot ring includes a rim.

11. The utility knife as set forth in claim 10, further including a curved hub wall inside said housing and extending about said opening; said rim is located adjacent to said hub wall and engaging at least a portion of said hub wall during use of said knife.

12. A utility knife comprising:

a housing;

said housing having a forward portion, a rear portion, and a middle portion;

a cutting member;

said cutting member being attached to said forward portion;

said rear portion, including a grip for enabling a user to grasp the knife with a hand;

a pivot ring having a hub hole for receipt of a finger;

said pivot ring being attached to said middle portion;

at least a part of said pivot ring being received inside said housing whereby the knife is stabilized during use;

said knife being adapted to cut a work piece;

said rear portion including a protruding section separate from said grip;

said protruding section being adapted to protect the hand of the user grasping the knife from contacting the work piece;

said protruding section including a skid plate.

* * * * *